US008746965B2

(12) United States Patent
Livshits et al.

(10) Patent No.: US 8,746,965 B2
(45) Date of Patent: Jun. 10, 2014

(54) METHOD OF DYNAMIC MIXING OF FLUIDS

(75) Inventors: David Livshits, San Francisco, CA (US); Lester Teichner, Chicago, IL (US)

(73) Assignee: Turbulent Energy, LLC, Buffalo, NY (US)

( * ) Notice: Subject to any disclaimer, the term of this patent is extended or adjusted under 35 U.S.C. 154(b) by 536 days.

(21) Appl. No.: 12/529,617

(22) PCT Filed: Sep. 5, 2008

(86) PCT No.: PCT/US2008/075366

§ 371 (c)(1),
(2), (4) Date: Sep. 2, 2009

(87) PCT Pub. No.: WO2009/033000

PCT Pub. Date: Mar. 12, 2009

(65) Prior Publication Data

US 2010/0243953 A1 Sep. 30, 2010

Related U.S. Application Data

(60) Provisional application No. 60/970,655, filed on Sep. 7, 2007, provisional application No. 60/974,909, filed on Sep. 25, 2007, provisional application No. 60/978,932, filed on Oct. 10, 2007, provisional application No. 61/012,334, filed on Dec. 7, 2007, provisional application No. 61/012,337, filed on Dec. 7, 2007, provisional application No. 61/012,340, filed on Dec. 7, 2007, provisional application No. 61/037,032, filed on Mar. 17, 2008.

(51) Int. Cl.

| | |
|---|---|
| ***B01F 3/00*** | (2006.01) |
| ***B01F 5/04*** | (2006.01) |
| ***B01F 5/02*** | (2006.01) |
| ***B01F 3/04*** | (2006.01) |
| ***B01F 3/08*** | (2006.01) |
| *B01F 5/00* | (2006.01) |

(52) U.S. Cl.

CPC ..... *B01F 5/0466* (2013.01); *B01F 5/0262* (2013.01); *B01F 3/04468* (2013.01); *B01F 3/0873* (2013.01); *B01F 2005/0034* (2013.01)

USPC ..... 366/348; 366/165.2; 366/175.2; 366/181.5; 366/337; 261/76

(58) Field of Classification Search

CPC ..... B01F 3/00; B01F 3/02; B01F 3/04; B01F 3/04468; B01F 3/0873; B01F 5/0057; B01F 5/0262; B01F 5/0466; B01F 5/0659; B01F 2005/0022; B01F 2005/0034

USPC ..... 366/165.1, 165.2, 175.2, 181.5, 337, 366/348; 261/76, 117

See application file for complete search history.

(56) References Cited

U.S. PATENT DOCUMENTS

| | | | |
|---|---|---|---|
| 2,295,740 | A | 9/1942 | Keen |
| 3,735,778 | A | 5/1973 | Garnier |

(Continued)

FOREIGN PATENT DOCUMENTS

| | | |
|---|---|---|
| DE | 3723618 | 12/1988 |
| DE | 4211031 | 10/1993 |

(Continued)

OTHER PUBLICATIONS

International Search Report and Written Opinion for PCT/US2008/075378.

(Continued)

*Primary Examiner* — Timothy Cleveland
(74) *Attorney, Agent, or Firm* — Vedder Price P.C.

(57) ABSTRACT

Methods are provided for achieving dynamic mixing of two or more fluid streams using a mixing device. The methods include providing at least two integrated concentric contours that are configured to simultaneously direct fluid flow and transform the kinetic energy level of the first and second fluid streams, and directing fluid flow through the at least two integrated concentric contours such that, in two adjacent contours, the first and second fluid streams are input in opposite directions. As a result, the physical effects acting on each stream of each contour are combined, increasing the kinetic energy of the mix and transforming the mix from a first kinetic energy level to a second kinetic energy level, where the second kinetic energy level is greater than the first kinetic energy level.

9 Claims, 11 Drawing Sheets

(56) References Cited

U.S. PATENT DOCUMENTS

| | | | | |
|---|---|---|---|---|
| 3,980,233 | A | 9/1976 | Simmons et al. | |
| 4,215,081 | A | 7/1980 | Brooks | |
| 4,218,012 | A | 8/1980 | Hamza et al. | |
| 4,398,827 | A | 8/1983 | Dietrich | |
| 4,415,275 | A | 11/1983 | Dietrich | |
| 4,464,314 | A | 8/1984 | Surovikin et al. | |
| 4,553,504 | A | 11/1985 | Duggal et al. | |
| 4,812,049 | A | 3/1989 | McCall | |
| 4,917,152 | A | 4/1990 | Decker | |
| 4,954,147 | A | 9/1990 | Galgon | |
| 5,174,247 | A | 12/1992 | Tosa et al. | |
| 5,176,448 | A * | 1/1993 | King et al. | 366/174.1 |
| 5,183,335 | A | 2/1993 | Lang et al. | |
| 5,330,105 | A | 7/1994 | Kaylor | |
| 5,372,281 | A | 12/1994 | Palmer et al. | |
| 5,449,114 | A | 9/1995 | Wells et al. | |
| 5,452,955 | A | 9/1995 | Lundstrom | |
| 5,460,449 | A | 10/1995 | Kent et al. | |
| 5,492,404 | A * | 2/1996 | Smith | 366/165.1 |
| 5,492,409 | A | 2/1996 | Karlsson et al. | |
| 5,575,561 | A | 11/1996 | Rohwer | |
| 5,657,631 | A | 8/1997 | Androsov | |
| 5,678,766 | A | 10/1997 | Peck et al. | |
| 5,820,256 | A | 10/1998 | Morrison | |
| 5,865,158 | A | 2/1999 | Cleveland et al. | |
| 5,918,465 | A * | 7/1999 | Schmid | 60/722 |
| 5,992,529 | A | 11/1999 | Williams | |
| 6,022,135 | A | 2/2000 | Williams | |
| 6,027,241 | A | 2/2000 | King | |
| 6,036,356 | A | 3/2000 | Yang et al. | |
| RE36,969 | E | 11/2000 | Streiff et al. | |
| 6,170,978 | B1 | 1/2001 | Short | |
| 6,203,186 | B1 * | 3/2001 | Cruz | 366/163.2 |
| 6,367,262 | B1 | 4/2002 | Mongia et al. | |
| 6,422,735 | B1 | 7/2002 | Lang | |
| 6,432,148 | B1 | 8/2002 | Ganan-Calvo | |
| 6,534,023 | B1 | 3/2003 | Liou | |
| 6,669,843 | B2 | 12/2003 | Arnaud | |
| 6,974,542 | B2 | 12/2005 | von Paul | |
| 6,986,832 | B2 | 1/2006 | Lamminen et al. | |
| 7,018,435 | B1 | 3/2006 | Wentinck | |
| 7,041,144 | B2 | 5/2006 | Kozyuk | |
| 7,165,881 | B2 | 1/2007 | Holl | |
| 7,448,794 | B2 | 11/2008 | Hansen | |
| 8,006,961 | B1 * | 8/2011 | Rutstein | 261/76 |
| 2007/0206435 | A1 | 9/2007 | Lester et al. | |
| 2008/0016968 | A1 | 1/2008 | McCall et al. | |
| 2008/0194868 | A1 | 8/2008 | Kozyuk | |

FOREIGN PATENT DOCUMENTS

| | | |
|---|---|---|
| DE | 29612769 | 12/1996 |
| DE | 2334901 | 9/1999 |
| DE | 10310442 | 9/2004 |
| EP | 0044498 | 1/1982 |
| GB | 2263649 | 8/1993 |
| JP | 56130213 | 10/1981 |
| JP | 62079835 | 4/1987 |
| JP | 51161899 | 6/1993 |
| JP | 8131800 | 5/1996 |
| JP | 2001000849 | 1/2001 |
| JP | 2006326498 | 12/2006 |
| KR | 20040040926 | 5/2004 |
| RU | 2133829 | 7/1999 |
| SU | 1662653 | 7/1991 |
| WO | WO88/06493 | 9/1988 |
| WO | WO93/07960 | 4/1993 |
| WO | WO00/12202 | 3/2000 |
| WO | WO2006/038810 | 4/2006 |
| WO | WO2006/117435 | 11/2006 |
| WO | WO2007/086897 | 8/2007 |
| WO | WO2007/115810 | 10/2007 |
| WO | WO2009/021148 | 2/2009 |
| WO | WO2009/035334 | 3/2009 |

OTHER PUBLICATIONS

International Search Report for International Application No. PCT/US2008/75366, Nov. 13, 2008, 2 pp.

Written Opinion for International Application No. PCT/US2008/75366, Nov. 13, 2008, 5 pp.

International Search Report for International Application No. PCT/US2008/75374, Mar. 23, 2008, 4 pp.

Written Opinion for International Application No. PCT/US2008/75374, Mar. 23, 2008, 8 pp.

* cited by examiner

METHOD OF DYNAMIC MIXING OF FLUIDS

CROSS REFERENCE TO RELATED APPLICATIONS

This application claims priority to the following U.S. provisional applications: U.S. Ser. No. 60/970,655, filed on Sep. 7, 2007, and entitled "Method and Device for Preparation and Activation of Fuel"; U.S. Ser. No. 60/974,909, filed on Sep. 25, 2007, and entitled "Method and Device for Preparation and Activation of Fuel"; U.S. Ser. No. 60/978,932, filed on Oct. 10, 2007, and entitled "Method and Device for Preparation and Activation of Fuel"; U.S. Ser. No. 61/012,334, filed on Dec. 7, 2007, and entitled "Method and Device for Preparation and Activation of Fuel"; U.S. Ser. No. 61/012,337, filed on Dec. 7, 2007, and entitled "Method and Device for Preparation and Activation of Fuel"; U.S. Ser. No. 61/012,340, filed on Dec. 7, 2007, and entitled "Fuel Preparation"; and U.S. Ser. No. 61/037,032, filed on Mar. 17, 2008, and entitled "Devices and Methods for Mixing Gaseous Components". This application also claims priority to International Application No. PCT/US08/75366, filed Sep. 5, 2008, and entitled "Method of Dynamic Mixing of Fluids". All the preceding applications are incorporated by reference in their entirety.

FIELD OF THE INVENTION

The invention relates to dynamic mixing of fluids.

BACKGROUND OF THE INVENTION

Mixing components of a mix is well known. The basic criterion for defining efficiency of a mixing process has been those parameters that define the uniformity of a resultant mix. But, the efficiency of a mixing process is better defined not only as the uniformity of the resultant mix, but should also include consideration of process parameters such as energy expense, process development time, stability of the condition of the mix, kinetic energy of the mix, as well as other considerations.

In some technologies there is a desire to mix various components having different properties such as organic and/or inorganic liquids, liquids and gases, various gases with various properties, such as natural gas, hydrogen or other gases, and a gas oxidizer that is air or oxygen.

Some effective known methods of mixing use what is known as a dynamic effect for process intensification and influence of a mix. Examples include those that use eductors, atomizers, or venturi devices that are more effective than mechanical mixing devices, and which generally dynamically affect only one component of a mix. Some systems and devices have limitations due to requirements for high energy inputs and the need to dynamically mix two or more components.

SUMMARY OF THE INVENTION

In one aspect, the invention relates to technologies of dynamic influence on various fluid environments, their mixing, and intensification of their level of kinetic energy.

More particularly, the technologies can be extended to areas of mixing of various liquids and/or gases, in various controllable proportions and combinations, with full and constant control of key parameters of the process, thereby defining the quality and parameters of a mix. The parameters may include velocity, pressure, direction, and level of kinetic energy.

In some embodiments, the technologies have application to areas that employ the results of dynamic mixing of fluids of various origins, organic and/or inorganic, having various physical and chemical properties, and degrees of activity. For example, the principles can apply to processes of mixing of liquids and liquids, liquids and gases, gases and aerosols, gases with gases, in various combinations and proportions. More particularly, the technologies can be employed in processes and devices for preparation of fuel mixes, for processes of technological mixing in all industries, and for a multitude of other non-industrial uses.

Embodiments concern technologies from which the properties of a mix and the change of properties of components of a mix result from the control of the dynamic parameters of a mixing process using a device having no moving parts. As a result of the dynamic influences on the mix components, the level of kinetic energy of the mix components change as does the level of kinetic energy of the resultant mix.

The invention therefore also concerns the resultant changes that arise from the combination of effects from various kinds of dynamic influence on components of a mix during the mixing process.

In some embodiments, a method of dynamic mixing of component streams to form a mixed stream is disclosed, the component streams including at least a first fluid stream and a second fluid stream. In the method, the integrated intensification of the kinetic energy level of the fluid streams is achieved with simultaneous transformation of the fluid properties of the mixed stream.

In some embodiments, the method includes: providing at least two integrated concentric contours that are configured to simultaneously direct fluid flow and transform the kinetic energy level of the first and second fluid streams, and directing fluid flow through the at least two integrated concentric contours such that, in two adjacent contours, the first and second fluid streams are input in opposite directions.

As a result, a zone of accumulation of kinetic energy of a mix is formed at the junction of the adjacent contours such that the stream of mix components which were originally input in opposite directions change direction and become co-terminus and mix.

As the component streams of the mix move into the zone of accumulation, the physical effects acting on each stream of each contour are combined, increasing the kinetic energy of the mix and transforming the mix from a first kinetic energy level to a second kinetic energy level, where the second kinetic energy level is greater than the first kinetic energy level. Each of the at least two integrated concentric contours operates independently.

In some embodiments, the first fluid stream is a liquid and the second fluid stream is a gas. In other embodiments, the first fluid stream is a first liquid and the second fluid stream is a second liquid. In other embodiments, the first fluid stream is a first gas and the second fluid stream is a second gas. In other embodiments, each of the at least two integrated contours includes no moving parts. In still other embodiments, each of the specified contours operates independently of the other contour, and employ one of the known dynamic physical principles of turbulence, such as the Bernoulli Effect.

In some embodiments, a method is disclosed which provides dynamic mixing of at least a first fluid stream and a second fluid stream to provide a mixed stream having increased kinetic energy and transformed properties. In such embodiments, the first fluid stream includes a liquid and the second fluid stream includes a gas.

The method includes the following method steps: providing at least two integrated concentric contours that are configured to simultaneously direct fluid flow and transform the energy level of the first and second fluid streams, and directing fluid flow through the at least two integrated concentric contours such that, in two adjacent contours, the first and second fluid streams are input in opposite directions, and a third fluid stream is added to the mixed stream in a direction perpendicular to the flow direction of the mixed stream.

As a result, a zone of accumulation of kinetic energy of a mix is formed at the junction of the adjacent contours such that the stream of mix components which were originally input in opposite directions change direction and become co-terminus and mix. As the component streams of the mix move into the zone of accumulation, the physical effects acting on each stream of each contour are combined, increasing the kinetic energy of the mix and transforming the mix from a first kinetic energy level to a second kinetic energy level, where the second kinetic energy level is greater than the first kinetic energy level. Each of the at least two integrated concentric contours operates independently.

In some embodiments, a method is disclosed which provides dynamic mixing of at least a first fluid stream and a second fluid stream to provide a mixed stream having increased kinetic energy and transformed properties. In such embodiments, the method includes the following method steps: providing at least two concentric vortex generating contours that are configured to simultaneously direct fluid flow and transform the energy level of the first and second fluid streams, and directing fluid flow through the at least two concentric vortex generating contours such that the fluid streams are input into one of the vortex generator contours, are mixed, and are provided with increased kinetic energy. In addition, a mixed stream flows from one of the vortex generator contours to a subsequent vortex generator contour, such that each subsequent vortex generator contour further strengthens the effect of transformation of the prior contour and further increases the turbulent energy of the component in the mix, a vortex spiral is formed in the center of the vortex generating contours, the spiral including a third fluid stream moving in a direction perpendicular to the direction of the linear streams of the mixed stream output from the vortex generating contours.

As a result, each of the at least two concentric vortex generating contours operates independently.

In some embodiments, the first and second streams are gases. In other embodiments, the first and second streams are liquids. In other embodiments, the first stream is a liquid and the second stream is a gas. In other embodiments, the at least two concentric vortex generating contours work together to direct fluid flow and transform the energy level of the first and second fluid streams. In still other embodiments, each of the at least two concentric vortex generator contours operates with no moving parts.

In some embodiments, the methods result in a mix of liquid and gas components, the mix containing a group of gaseous-liquid capsules consisting of gas bubbles having internal pressure more than atmospheric pressure, and the gas bubbles including a coating on the surface of the gas bubbles formed of dynamically mixed liquid components.

In some embodiments, the coating on the surface of the gas bubbles further comprises spherical coatings on the surface of gas bubbles. In some embodiments, the gas components are input into the mix as gas bubbles with an internal pressure greater than atmospheric pressure, and the group of gaseous-liquid capsules include compact groups of gaseous-liquid capsules in which the capsules are in contact with each other on polar points of the capsules' spherical surface coating.

In some embodiments, a method is disclosed which provides dynamic mixing of at least one liquid stream and a gas stream to form a mixed stream. In such embodiments, the method includes: dynamic dispersal of a first liquid stream and transformation of the first liquid stream from a first level of kinetic energy to a second level of kinetic energy, where the second level is greater than the first level; formation of an external ring zone of lowered pressure in a zone of maximal dispersal of the first liquid stream; simultaneously with dynamic dispersal of the first liquid stream and transformation of the first liquid stream, dynamic dispersal of the gas stream and transformation of the gas stream from a third level of kinetic energy to a fourth level of kinetic energy, where the fourth level is greater than the third level; formation of an internal ring zone of lowered pressure concentric to the external ring zone of lowered pressure, in a zone of maximal dispersal of the gas stream; input of a second liquid stream into a coaxial ring zone of lowered pressure of the second liquid stream; dynamically mixing the second liquid stream with the first liquid stream; simultaneously with dynamically mixing the second liquid stream with the first liquid stream, inputting the gas stream into the mixed first and second liquid streams, the gas stream including a stream of gaseous bubbles under pressure; and mixing of the gas stream with the first and second liquid streams, under conditions in which the volume of the resultant mixed stream is continuously compressed and the internal pressure of the gas bubbles in the capsules is increased and their diameters are reduced, resulting in formation of groups of gaseous-liquid capsules having gas bubbles therein.

In some embodiments, the methods result in a mix of two or more fluid streams. The mix contains a first fluid stream directed to move tangentially with respect to an axis at a radial distance from the axis, and a second fluid stream directed to move linearly in the axial direction and intersect the first fluid stream, portions of the first fluid stream intersecting the second fluid stream at regular intervals along the axis. The mix of the two or more fluid streams moves in a spiral flow path about the axis.

In some embodiments of the mix, the first fluid stream comprises a first gas stream and the second fluid stream comprises a second gas stream. In other embodiments, the first fluid stream comprises a gas stream and the second fluid stream comprises a liquid stream.

In some embodiments, a method is disclosed which provides dynamic mixing of two or more gas streams to form a mixed stream. In such embodiments, the method includes: formation of a first gas stream; controlling and regulating at least one of the direction, the velocity, the pressure and the kinetic energy of the first gas stream; uniformly distributing at least a second gas stream into the first gas stream in a direction tangential to a flow direction of the first gas stream; using the flow of the second gas stream to form a vortex spiral concentric to the direction of flow of the first gas stream; and controlling and regulating at least one of the direction, the velocity, the pressure and the kinetic energy of the mixed stream to synchronize the flow of the mixed stream with that of the first gas stream.

In some embodiments, the vortex generator contours may be applied to mixing and activation of gases. For example, the vortex generator contours may have application to the extraction of water from exhaust gases of an engine. In another example, the device may be used to mix and activate a fuel mix. The vortex generator contour, which is applied in vortex devices to achieve mixing and activation of gases, provides the additional benefit of allowing cooling effect greater than that from only throttling of pressure or adiabatic expansion of the compressed air leaving tangential channels of the specified generator.

In the device, pressurized fluid is directed into the ring channel of the housing of the vortex generator, and from there through transit channels, acts in the tangential channels of the device, and exits forming a vortex spiral. On exit from the tangential channels in the housing of the vortex generator, adiabatic expansion of the fluid occurs according to the Joule-Thompson effect and the temperature of the fluid decreases proportionally to a difference in the pressure of expansion. During an output of the fluid from tangential channels of the device and adiabatic expansion, the vortex spiral is formed. This establishes conditions for occurrence of the Ranque Effect and results in a further decrease in temperature. Cumulative decreases in temperature in the streams of fluid also cool the housing of the vortex generator below the temperature of air. During compression in the compressor, the temperature of the fluid increases and, at its input in the collecting ring channel of the housing of the vortex generator contour, a primary condensation of water occurs and the temperature of the fluid thus decreases.

On output from tangential channels at adiabatic expansion, there is a second stage of cooling which is defined by a difference in pressure before and after adiabatic expansion. By a change of pressure, the temperature changes, providing a temperature of at or below the dew-point. Thus, if temperature in a stream of air is below zero, water in air freezes and turns to ice crystals. Exhaust gases act in the central channel of the housing of the vortex generator contour in which a contact surface is created. Hot exhaust gases contact a cold surface of the housing of the vortex generator contour, which causes a reduction of temperature. Water, which is a part of the exhaust gas, is condensed on the cooled contact surface.

Features of the devices, systems and methods described herein, whether for dynamic mixing and activation of several fluid components, mixing, cooling and extraction of water from several gas components, or for cooling a stream of compressed air and extracting potable water from it, include the positive kinetic energy effects gained by overlapping several widely known physical principles in one device with no moving parts and internal geometries within to further enhance these effects. The benefits include the formation of liquid, gaseous, or combination streams with higher kinetic energy at lower energy inputs to achieve a desired result, in smaller devices with more simplified designs and lower operating costs.

In addition, the ability to overlap various effects from the several physical phenomena and further enhance them with internal energy enhancing geometries, permits the development of new mixes of various liquid and/or gas components which may otherwise not be achievable with less intensive mixing and activating methods.

The overall improvement in kinetic energy production may be in excess of 5× what is otherwise available from other devices inputting the same energy.

The benefits of these new mixes and the methods to produce them when applied to mixing fuels also promote more efficient fuel burning, better control over combustion processes, and new and improved approaches to efficient system design in many applications.

Examples of basic principles that are applied include several examples. For dynamic mixing and activation of several fluid components, for example, liquids with liquids, gases with gases, or liquids with gases, simultaneous action and mutual influence of the Bernoulli Effect in a stream of a liquid and The Bernoulli Effect in a stream of a gas (Control of this process by only control of the liquid and gas pressures). For dynamic mixing, cooling and extraction of water from several gas components and for cooling a stream of compressed air and extracting potable water from it, continuous overlapping of the cooling effect from adiabatic expansion (Joule-Thompson phenomena) and of Ranque Effect phenomena.

In addition to the underlying basic principles, examples of other geometric designs within the devices further strengthen the cumulative effects that arise from application of the technologies include: transformation of a hydraulic stream from a stream with a round cross-section to a stream with a ring cross-section, creating turbulence and enabling greater penetration of gas components into the overall liquid volume; formation of consecutive volumetric zones of lowered pressure and the input of the various components of mixes at higher pressures into these zones causing intensive mixing; and formation of hydraulic and pneumatic passageways that accelerate fuel components as well as to create vortices and turbulence.

BRIEF DESCRIPTION OF THE DRAWINGS

The present invention is explained with reference to the drawings.

DESCRIPTION OF THE PREFERRED EMBODIMENTS

Figure 1A:
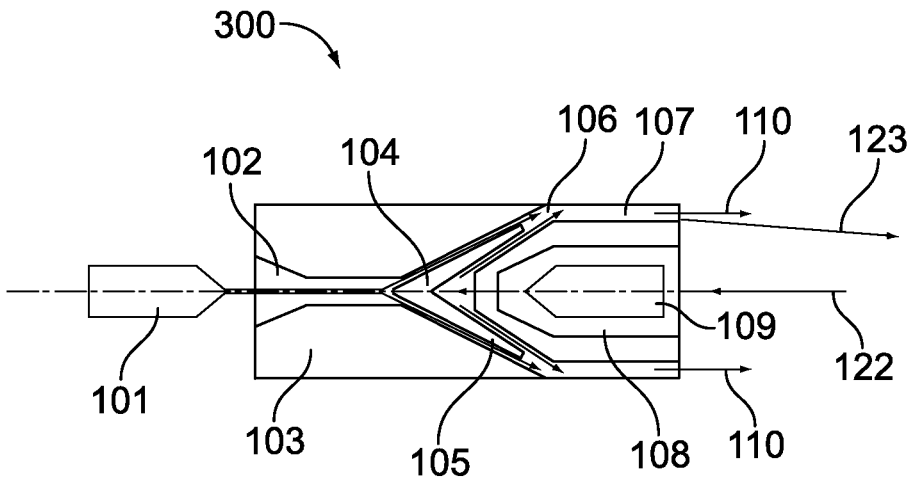
FIG. 1A is a diagrammatic view of a mixing device.
Figure 1B:
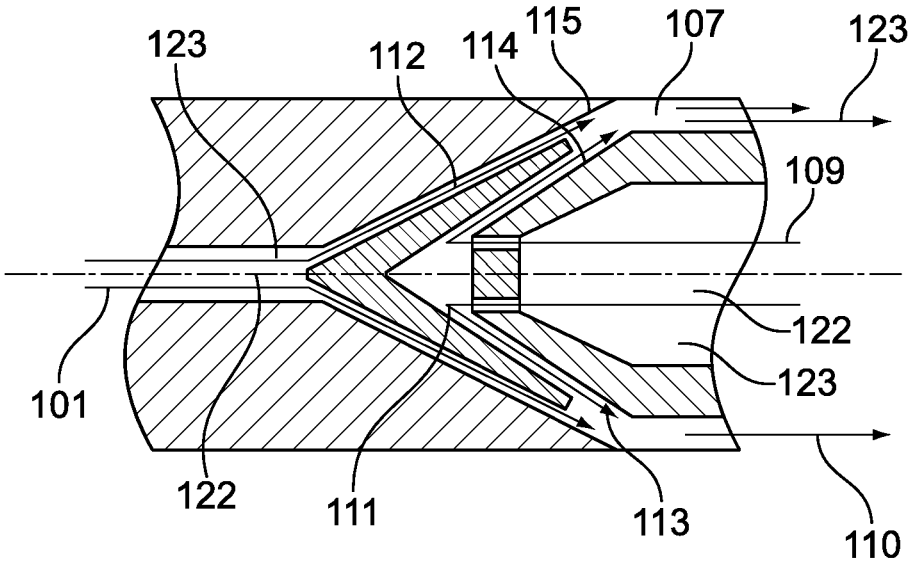
FIG. 1B is a sectional view of the device of FIG. 1A.
Figure 1C:
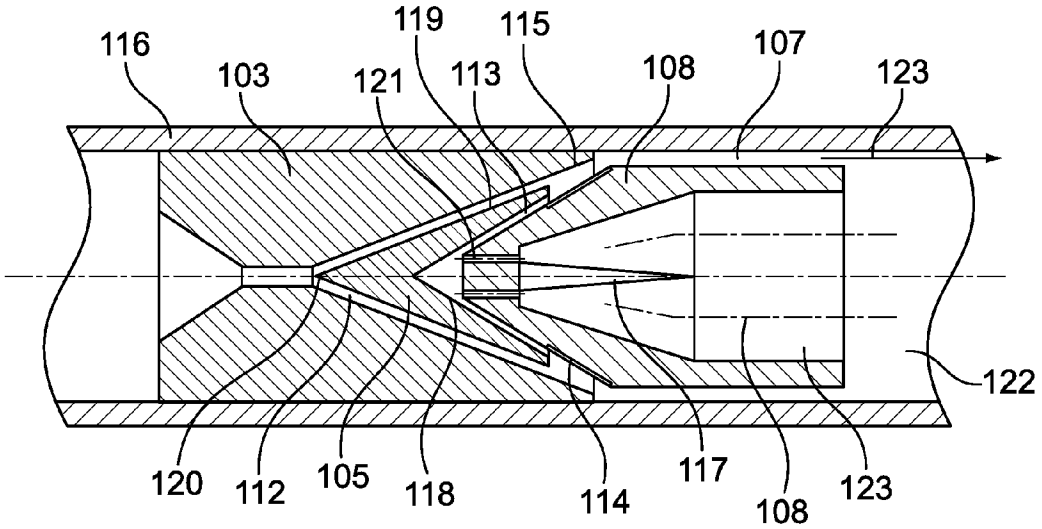
FIG. 1C is a sectional view of the device of FIG. 1A disposed within a pipeline.

FIGS. 1A-1F illustrate an embodiment of the fluid mixing device 300 which consists of two concentric contours 100, 200 for dynamic mixing and activation of fluids in a consecutive mode of two components of a mix. FIGS. 1A-1D include the following features:

101, —A first component of a mix;

102, —An entrance channel of the first contour 100, in which the first component of a mix 101 enters the device 300;

103, —A housing of the first contour 100;

104, —A zone of change of a direction of movement of a stream of the second component of a mix 109;

105, —A reflector with external 119 and internal 118 reflecting surfaces. The first external reflecting surface 119 is on a course of movement of a first stream of components of a mix (corresponding to the first component 101) to a contour 100, and the internal reflecting surface 118 is on a course of movement of a second stream of components of a mix (corresponding to the second component 109) to a contour 200;

106, —A ring zone established on the border between the first 100 and second 200 contours in which there is an addition of energy characteristics as the component streams enter zone 106 of the energy previously gained by each of the component streams in the low pressure zones of each of the contours 100 and 200. The preliminary activated turbulent streams of components of a mix from contour 100 and contour 200 are output into zone 106 and these two streams are mixed due to creation of increased low pressure on all surfaces of zone 106. These low pressure areas have the effect of pulling the component streams from contour 100 and contour 200 onto the surfaces of the contours within zone 106 thereby combining the kinetic energy of each of the streams;

107, —A ring zone in which the final formation of a mix occurs;

108, —A housing of the second contour 200 in which the second component of a mix 109 enters, in a direction opposite to a direction of movement of the first component 101 of a mix;

109, —A second component of a mix;

110, —A output of a mix from the second contour 200;

111, —A location corresponding to a change of a direction of a stream of the second component of a mix 109;

112, —A conical ring extending channel for dispersal within the limits of the first contour 100 of the first component of a mix 101;

113, —A conical ring extending channel for dispersal within the limits of the second contour 200 of the second component of a mix 109 after change of a direction of movement;

114, —A conical ring surface of the second contour 200 on which the internal area of low pressure in a stream of the second component of a mix 109 is created, after passing a dispersal stage; and

115, —A conical ring surface of the first contour 100 on which the external area of low pressure in a stream of the first component of a mix 101 is created, after passage of a stage of dispersal.

Figure 1D:
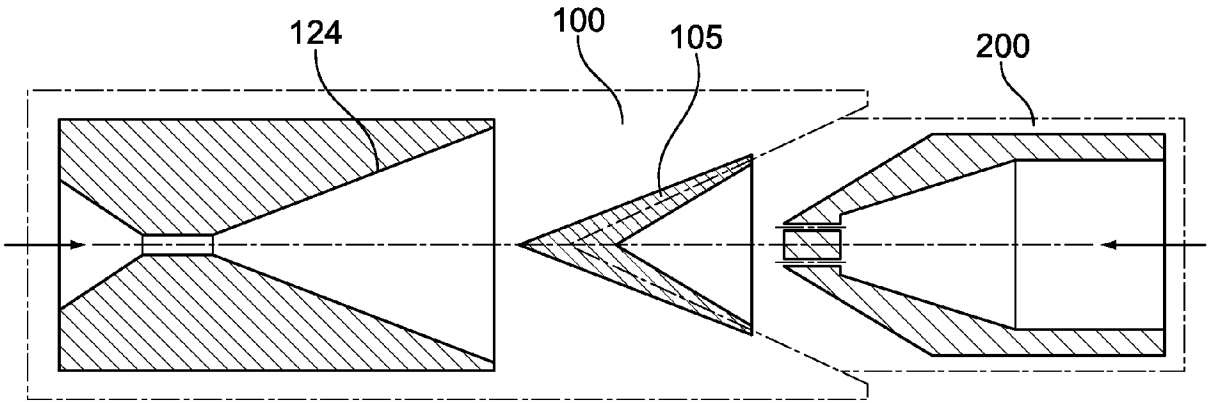
FIG. 1D is a diagrammatic view of elements of two contours for dynamic mixing and activation of various fluids.

Referring now particularly to FIGS. 1C-1F, two consecutive contours for dynamic mixing in a pipeline are shown. In FIG. 1D, two combined contours 100, 200 for dynamic mixing are shown. The double reflector 105 is the basic element which connects the first contour with the second contour wherein the external conical surface 119 of reflector 105 is incorporated as a working component of the first contour 100 and the internal conical surface 118 of reflector 105 is incorporated as a working component of the second contour 200. FIGS. 1C-1F include the following features:

116, —the pipeline in which the dynamic mixing of at least two various components of a mix occurs;

117, —a reflector which is incorporated as a working component of the second contour 200;

118, —an internal conical surface of the reflector 105 which is incorporated as a working component of the second contour 200;

119, —an external conical surface of the reflector 105 which is incorporated as a working component of the first contour 100;

120, —top of an external conical surface of the reflector 105 which is incorporated as a working component of the first contour 100;

121, —apertures or channels in the housing 108 of the second contour 200 which disperse the second component of a mix 109 before changing the direction of its flow.

The following process describes the mechanism of mixing the components of a mix:

In device 300, the first component of a mix 101 enters into the channel 102 within housing 103 of the dynamic mixing contour 100. At this stage, the stream of the first component of a mix has certain parameters and a first level of turbulence.

Upon meeting with the top 120 of the external conical surface 119 of reflector 105, the stream of the first component of a mix 101 will be volumetrically transformed from cylindrical to conical shape which extends as the stream flows.

This transformation occurs as the conical surface 124 in housing 103 of contour 100 and the conical surface 119 of reflector 105 form the conical channel 112. In the conical channel 112, the stream of the first component of a mix 101 changes its parameters of speed and pressure in such a manner that, on output from channel 112, the flow rate increases which reduces the local pressure in ring zone 106, especially in a zone adjoining to the conical surface 115 which is an extension of conical surface 124.

Due to a difference in pressure in the stream of the first component of a mix in channel 112 and the lower pressure on the surface 115, there is a further cross-section pulling effect that draws the stream of the first component of a mix to the surface 115.

Simultaneously with the flow and transformation of the first component of a mix, the second component of a mix 109 enters into the housing 108 of contour 200 in a direction opposite to a direction of movement of the stream of the first component of a mix 101.

As the second component of mix 109 flows along the surfaces of the reflector 117 in housing 108, its volumetric form changes and becomes a ring section stream as it passes through apertures 121 in housing 108. and the stream of the second component of a mix gains linear speed and increases its level of turbulence.

In this condition, on output from apertures 121, the stream of the second component of a mix hits in the internal conical surface 118 of reflector 105 and then changes its direction of movement to the opposite direction, coinciding with the direction of movement of the stream of the first component of a mix 101.

The stream 109 enters in conic channel 113, which is created by the internal conical surface 118 of reflector 105 and the external conical surface of housing 108. In channel 113, the stream of the second component of a mix also increases its linear speed of movement and a local area of low pressure is formed on surface 114.

Due to a difference in pressure in the stream of the second component of a mix in channel 113 and the lower pressure on the surface 114, there is a further cross-section pulling effect that draws the stream of the second component of a mix to the surface 114.

As surfaces 114 and 115 are both in ring channel 106, this mutually drawing of streams of the first and second components of the mix to surfaces 114 and 115 provides a high efficiency of hashing and simultaneous accumulation of the kinetic energy of the two streams.

The final establishment of the new parameters and properties of the stream of the combined mix after transformation, with at least the summation of the kinetic energy of each of the two component streams, occurs in the ring zone 107.

Figure 1E:
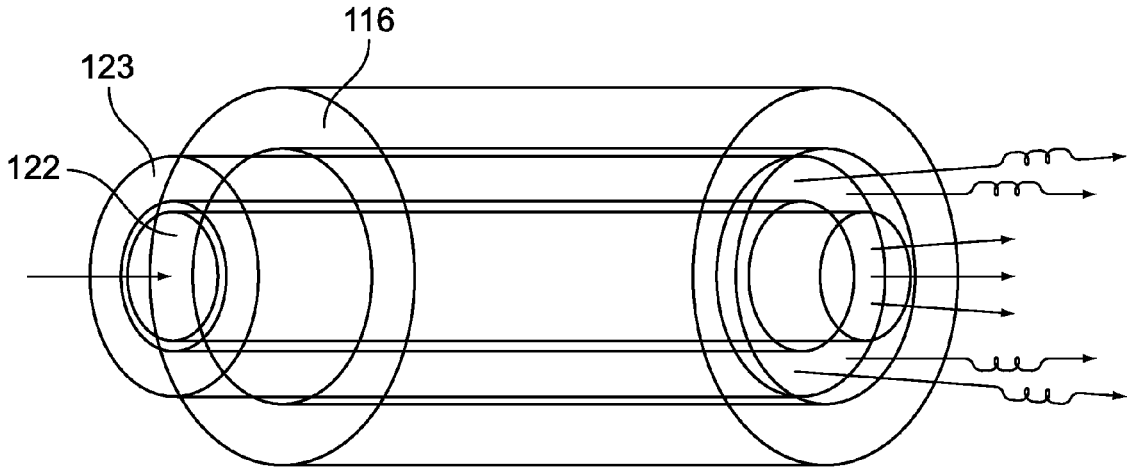
FIG. 1E is a diagrammatic view of turbulent flow in pipe.
Figure 1F:
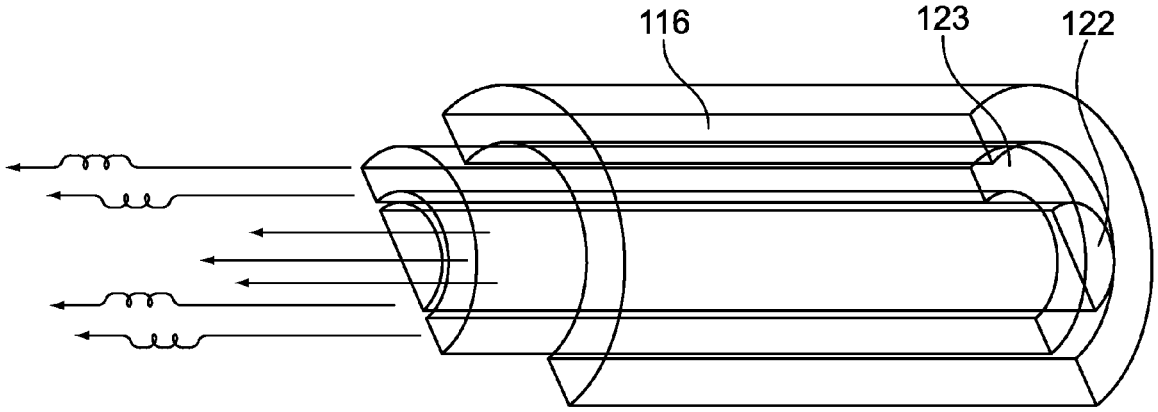
FIG. 1F is a diagrammatic sectional view of FIG. 1E.

In comparison to the mixing device 300, turbulent flow in a hollow pipeline 116 is illustrated in FIGS. 1E-1F. In these figures, 123 represents a region of turbulent flow along the inner surfaces of the pipeline 116, and 122 represents a region of laminar flow within, and coaxial with, pipeline 116 and region 123. FIGS. 1E-1F include the following features:

116, —the pipeline in which the stream of a component of a mix flows.

122, —a cylindrical region of laminar flow.

123, —an annular region of turbulent flow.

Depending on an initial condition of a stream moving in a pipeline 116, the level of turbulence can be changed. At any initial level of turbulence in the pipeline, the stream has a lower level of turbulence in the center of the flow than on periphery of the pipeline. Thus application of conical reflectors within a pipeline (as provided in mixing device 300) allows a stream to be moved to a peripheral zone of the pipeline and to receive the greatest possible turbulence without addition of energy to the system, using only that kinetic energy which was in the initial stream of the mix component.

In mixing device 300, as speed of movement of a stream of the first component of a mix 101 within the limits of contour 100 and speed of movement of a stream of the second component of a mix 109 within the limits of contour 200 increases in the conical ring section channels, and they are output on surface 115 of contour 100 and surface 114 of contour 200, zones of lower pressure are formed and there is a dynamic mixing of the two streams and thus there is at least a summation of the kinetic energy stored within each of the streams.

At the output from contour 100 and the output from contour 200, both streams of components of a mix have the cross-sectional form of a conical ring which extends in the direction of movement of both streams. For this reason, at their integration, the mix receives the greatest possible level of turbulence without the addition of any external energy in ring zone 106 and through its continuation ring zone 107.

The mix, which has finally issued in ring zone 107, has a level of kinetic energy equal at least to the sum of levels of kinetic energy of each of streams. In addition, the linear vector of speed at mixing two streams coincides with a linear vector of the axial effort developed by each streams, which increases the total level of kinetic energy of the integrated stream of a mix on output from the channel 107.

Figure 2A:
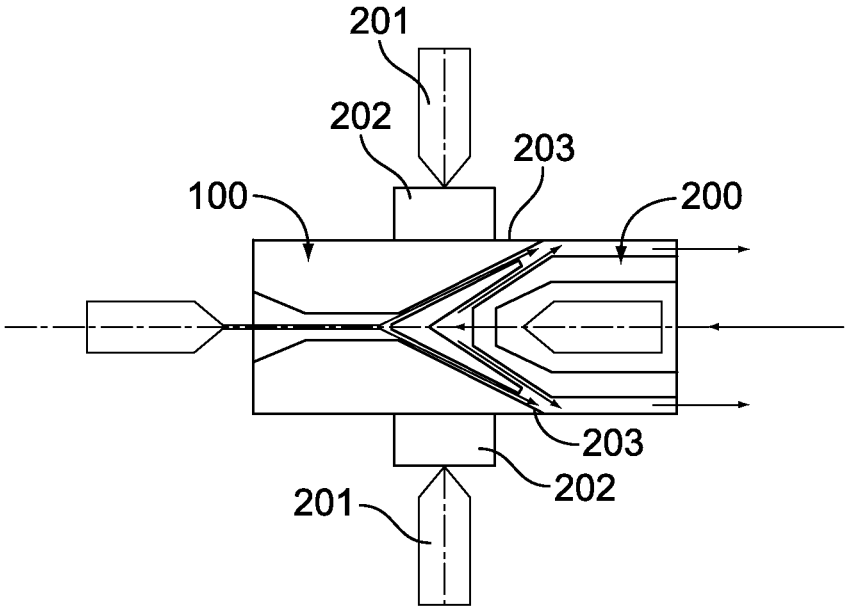
FIG. 2A is a diagrammatic view of the device of FIG. 1A to which a third contour is attached.

FIG. 2A shows an embodiment of the device for dynamic mixing and activation consisting of two concentric contours 100 and 200 to which a third contour is attached in the location of their connection. Other additional contours can also be attached in the same area. The area of attachment is in an area of external low pressure that forms a ring zone in which the kinetic energy of each incoming stream is increased due to the difference between the higher pressure of the incoming stream and the low pressure in the ring zone.

Contours 100 and 200 can be used in combination with additional contours which join with the first two. In the additional contours, a direction of movement of a stream of a component of a mix in the additional contours is perpendicular to the direction of movement of components of the mix in contours 100 and 200.

Figure 2B:
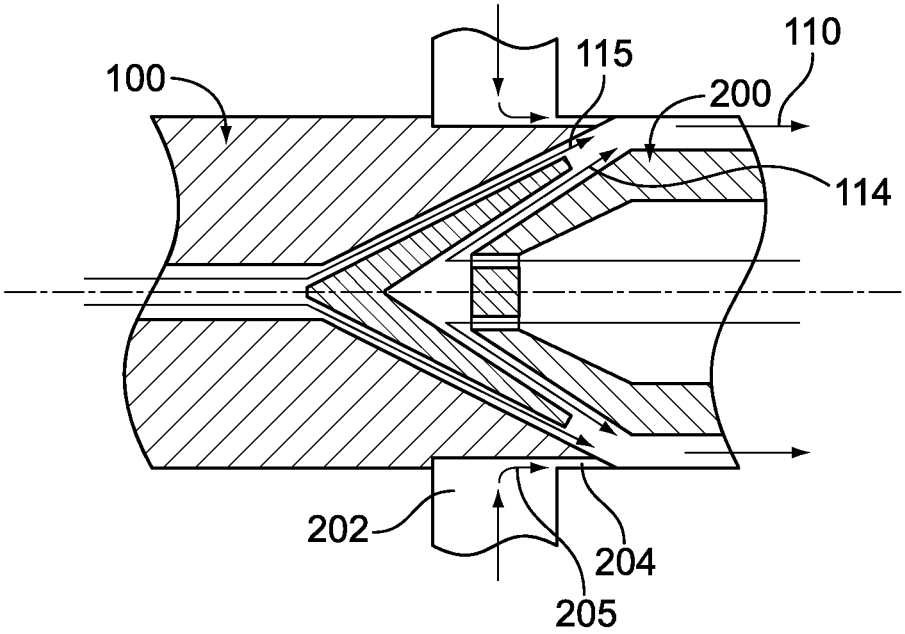
FIG. 2B is a sectional view of the device of FIG. 2A.

In FIGS. 2A and 2B, additional contours 202 are shown of which there can be more than one, and in which the additional component of a mix 201 flows. In contours 100 and 200, contour 202 is connected to ring zone 106 by means of channels 203 and 204. The additional component of a mix 201 under the influence of a pressure lower in ring zone 106 than in the channels 203 and 204, flows into ring zone 106 where it mixes with the turbulent streams of components of a mix 101 and 109. By means of this method of mixing in an existing configuration of contours of dynamic mixing in zone 106 of contours 100 and 200, only the kinetic energy of components of a mix 101 and 109 are needed to dynamically mix them with additional streams of additional components 201.

Two or more mixing devices 300 can be combined to form a combined device. As seen in the embodiments shown in FIGS. 3A and 3B, a combined device can consist of multiple serially consecutive mixing systems 304, 305, each of which can have two or more contours. For example, in the combined device shown in FIG. 3B, which is a combined device for dynamic mixing and activation in which two mixing systems 304, 305 are employed, the first system 304 is connected to the second system 305 in a junction of its contours, and the mix 302 from the first system 304 is one of components of a mix of the second system 305. In addition to the component of a mix of the second system 305, there is an input (for example at 308 or 309) from a tank not connected with the first system 304. Thus the mix 302, is the first component submitted on mixing in system 305, which also consists of two integrated contours 100 and 200. In system 305, this complex component consisting of a mix of components 301, 306 and 307 mixes with components 308 and 309, and when this mix outputs from system 305 in a mix 303, its components are 301, 306, 307, 308 and 309.

Figure 3A:
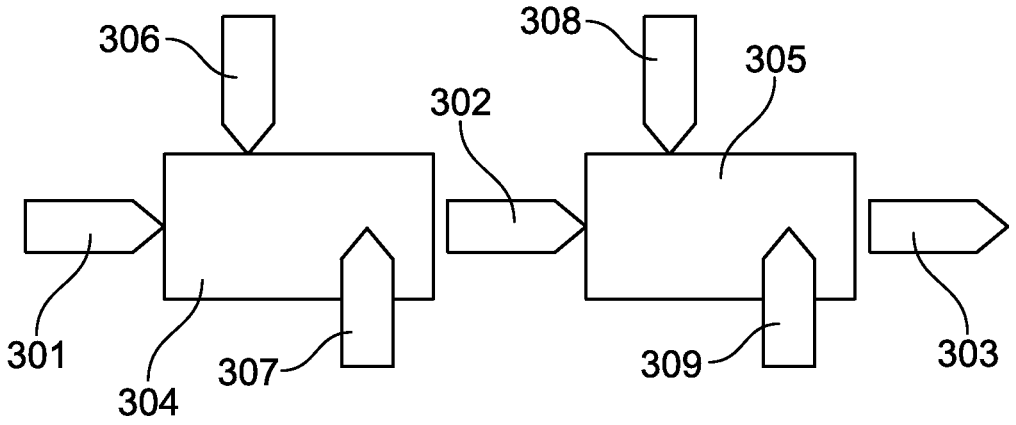
FIG. 3A is a block diagram of an embodiment of a combined device for dynamic mixing and activation.
Figure 3B:
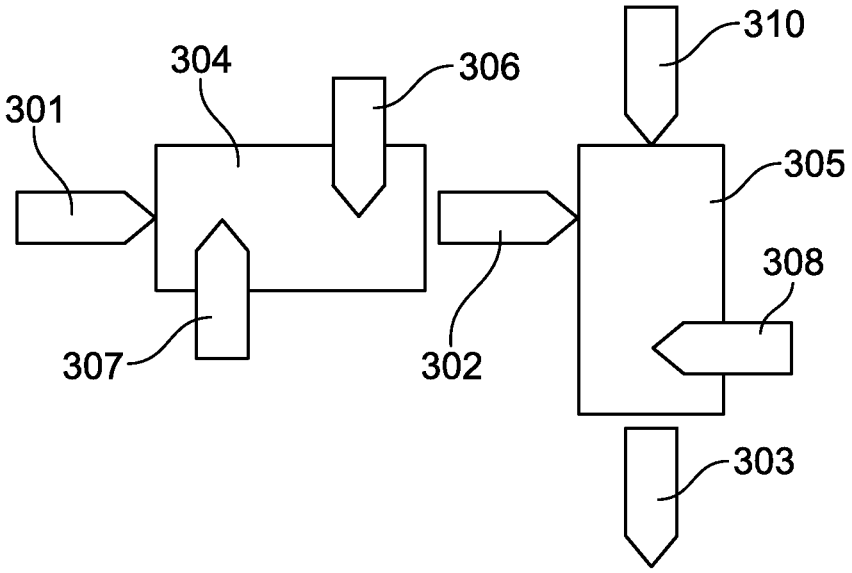
FIG. 3B is a block diagram of another embodiment of a combined device for dynamic mixing and activation.

FIGS. 3A and 3B include the following features:

301, —A first component of a mix of the first system 304. The first component 301 is input into the first contour 100 of the first system 304;

302, —A mix generated in the first system 304. In FIG. 3A, the mix 302 generated in the first system 304 is input into the first contour 100 of the second system 305. In FIG. 3B, the mix 302 generated in the first system 304 is input by means of the second contour 200 of the second system 305;

303, —A mix leaving the second system 305;

304, —A first system. The first system 304 includes three contours 100, 200, 203;

305, —A second system. The second system 305 includes three contours 100, 200, 203;

306, —An third component of a mix which enters the first system 304 by means of the third contour 203 of the first system 304;

307, —A second component of a mix which enters the first system 304 through the second contour 200 of the first system 304;

308, —A fourth component of a mix which enters the second system 305 by means of the third contour 203 of the second system 305;

309, —A fifth component of a mix which enters the second system 305 through the second contour 200 of the second system 305; and

310, —A first component of a mix of the second system 305. In FIG. 3B, the first component 310 is input into the first contour 100 of the second system 305.

Figure 4A:
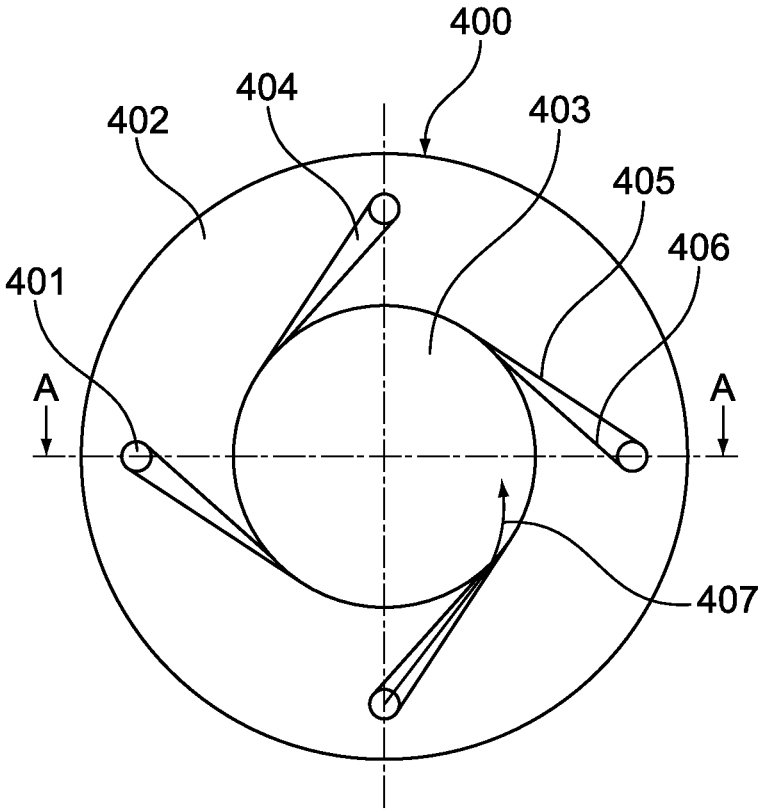
FIG. 4A is a diagram of an individual vortex generator contour used in systems of dynamic vortex mixing and activation.
Figure 4B:
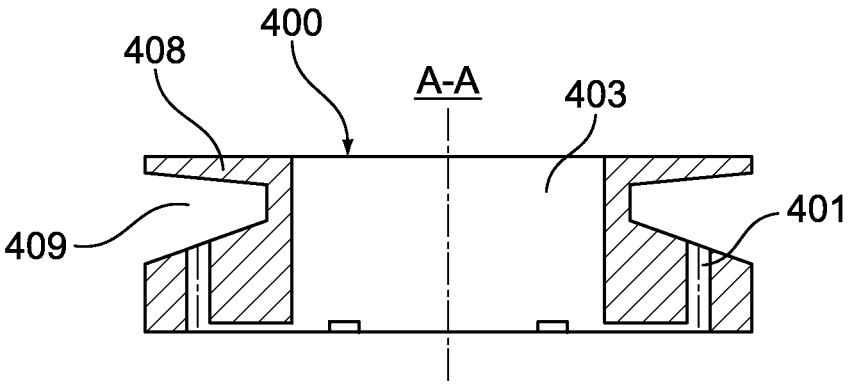
FIG. 4B is a side sectional view as seen along line A-A of FIG. 4A.
Figure 4C:
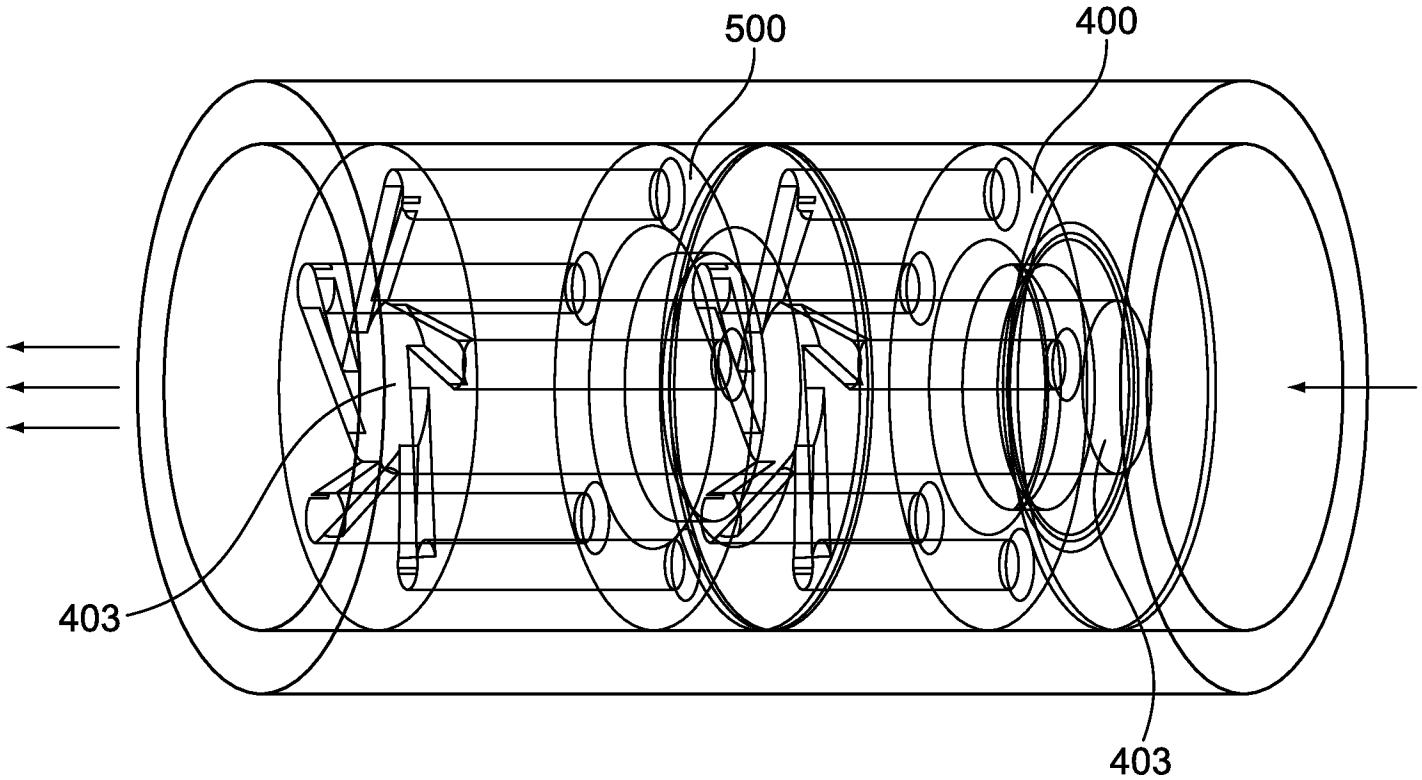
FIG. 4C is a diagram of two dynamic vortex mixing contours.
Figure 4D:
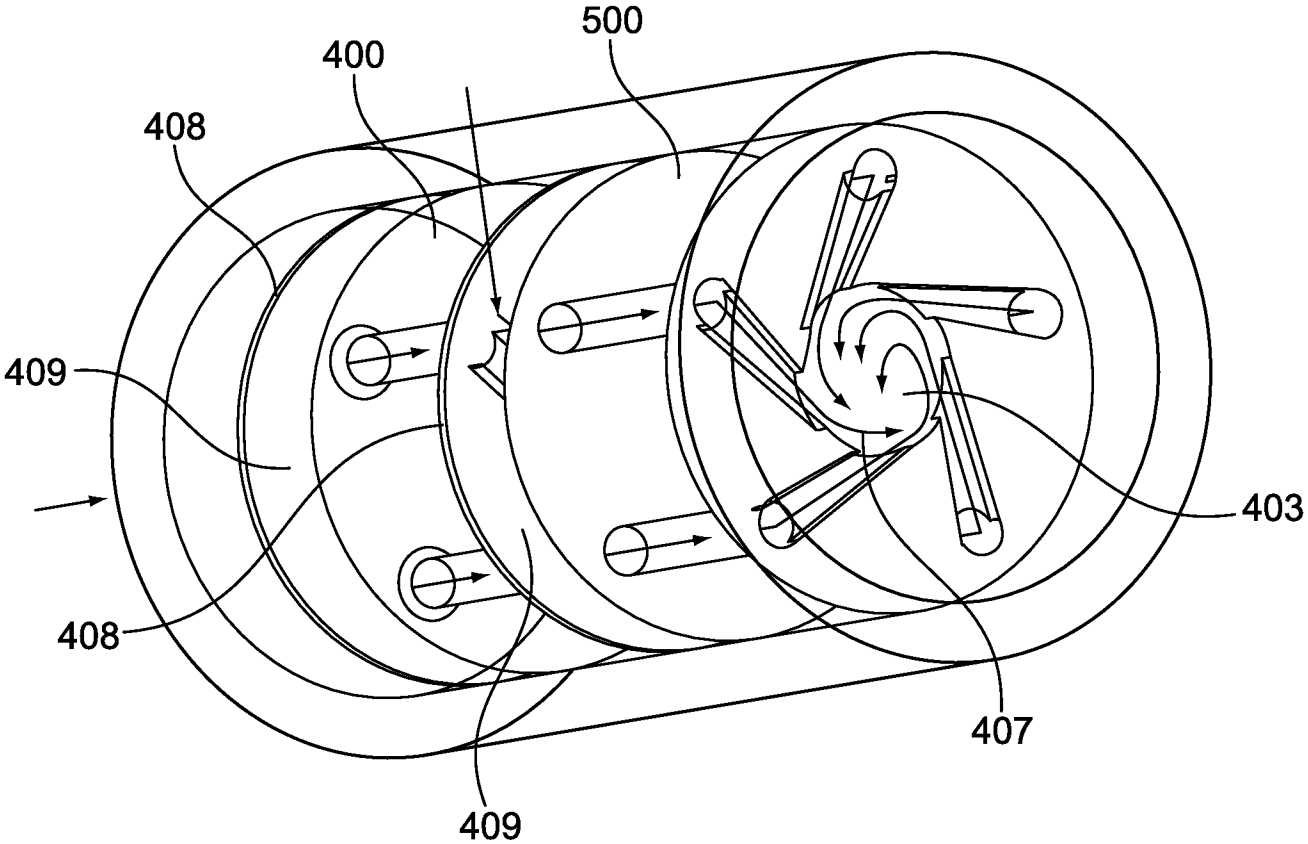
FIG. 4D is a diagram of two dynamic vortex mixing contours.
Figure 4E:
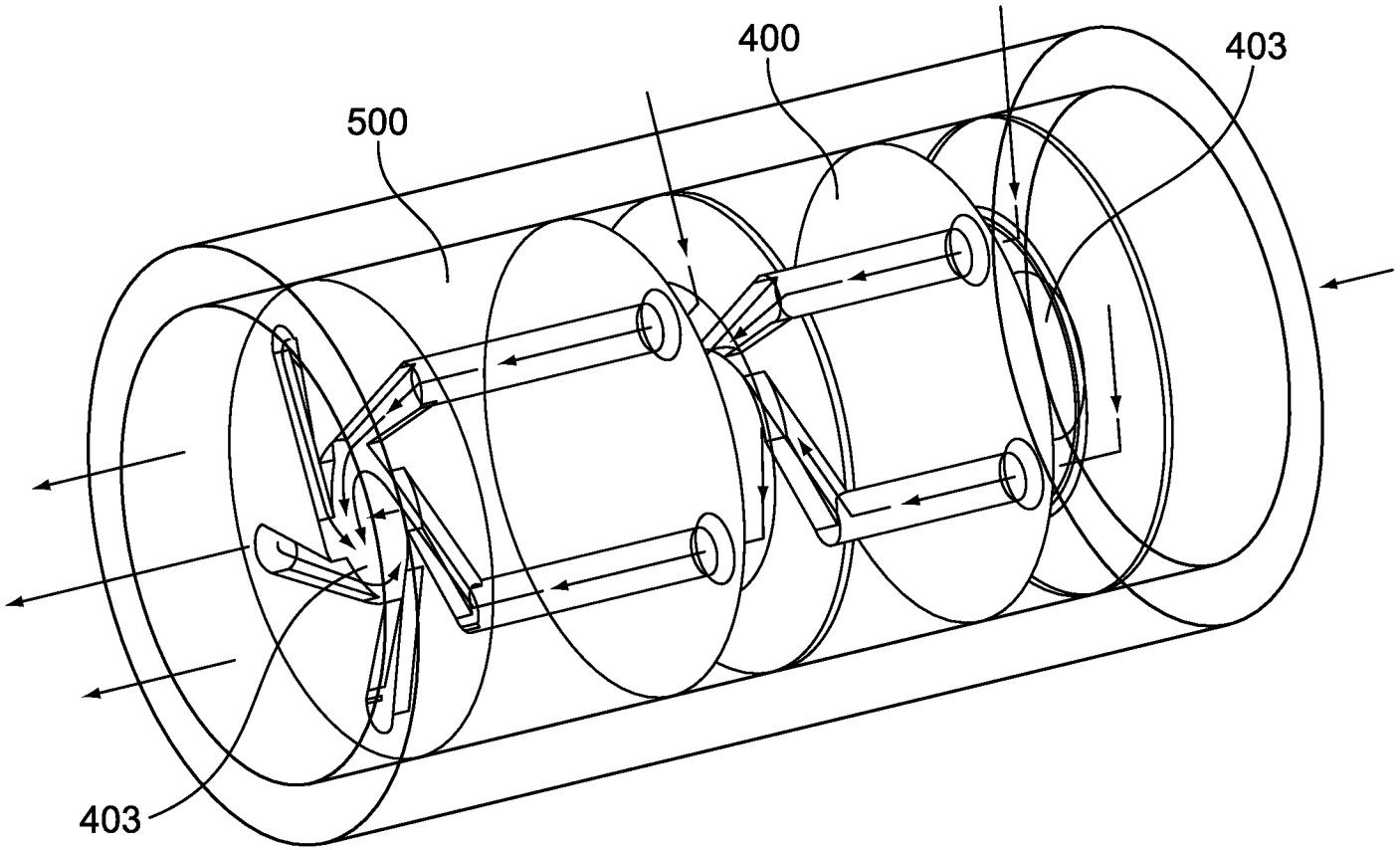
FIG. 4E is a diagram of two dynamic vortex mixing contours.
Figure 4F:
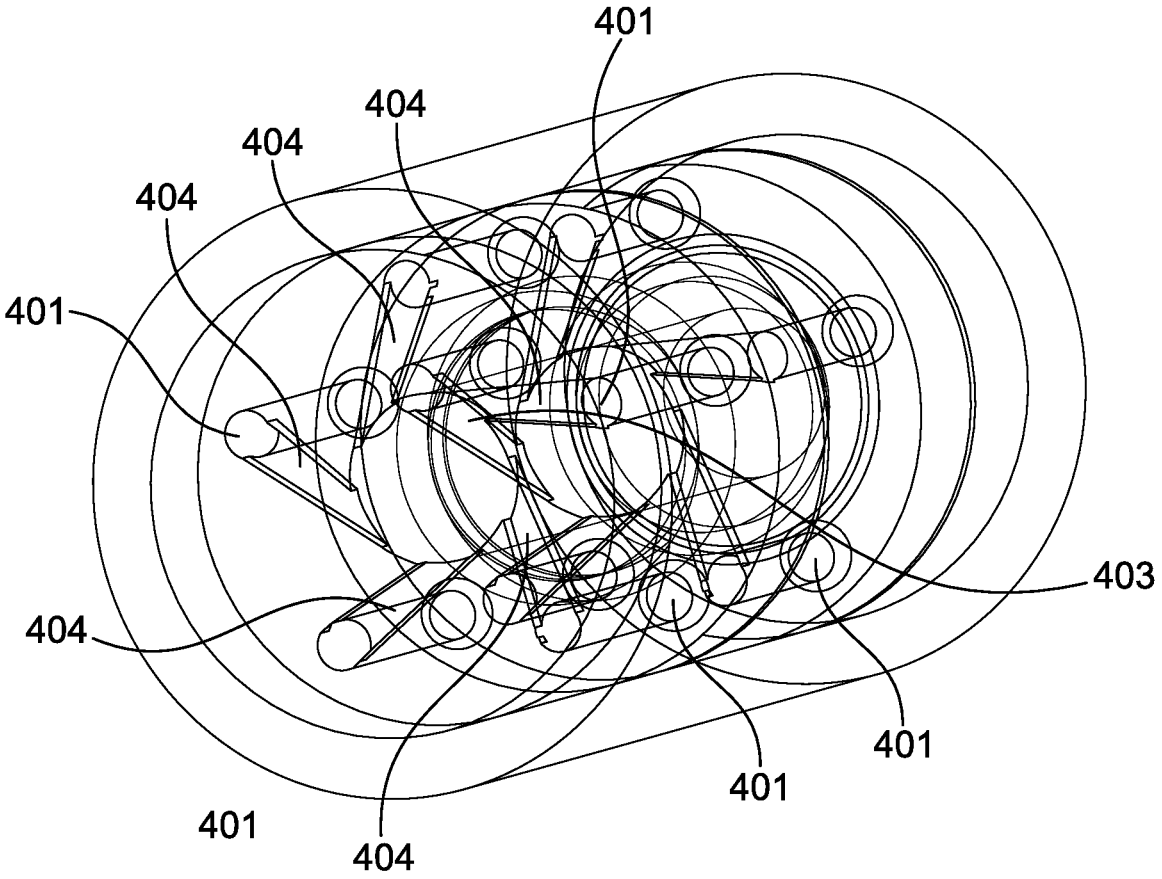
FIG. 4F is a diagram of two dynamic vortex mixing contours.

FIG. 4A is a diagram of an individual vortex generator contour 400 showing tangential channels 404 of the vortex generator contour 400 used in systems of dynamic vortex mixing and activation, and FIG. 4B is the view seen along line A-A of FIG. 4A. The vortex generator contour 400 includes an axial cylindrical channel 403, and plural tangential channels 404 extending tangentially inward from the axial cylindrical channel. The ends of tangential channels 404 open into the axial cylindrical channel, and a vortex spiral 407 is formed within the axial cylindrical channel 403 around a stream of one of the components of a mix.

FIGS. 4A and 4B include the following features:

401, —Transit apertures for submission of one of the component mixes to tangential channels 404 and for the subsequent transformation of their incorporated stream to a vortex spiral 407;

402, —A housing of the vortex generator contour 400;

403, —An axial cylindrical channel in which a vortex spiral 407 is formed. When at least two individual vortex generator contours 400 and 500 are axially connected, the connected vortex generator contours 400, 500 share the axial cylindrical channel 403, which includes the tangential channels 404 belonging to each of the specified vortex generator contours 400, 500;

404, —A tangential channel. The tangential channel 404 is a groove formed in an end face of the housing 402;

405, —A first wall of the tangential channel 404 being a tangent to a cylindrical surface of the axial cylindrical channel 403;

406, —A second wall of the tangential channel 404;

407, —An output of a stream of a component of a mix from the tangential channel 404 in the axial cylindrical channel 403, shown in the beginning of process of formation of a vortex spiral;

408, —A basic flange of the vortex generator which is intended for creation of the fourth wall of the tangential channels 404; When two or more vortex generator contours 400, 500 are connected together into one system, tangential channels 404 are formed from walls 405 and 406 in housing 402, and flange 408 completely encloses, as the fourth wall, the other three walls 402,405, 406 of the tangential channels 404; and

409, —A ring channel which stores a stream of a component of a mix and allocates a stream of a component of a mix between transit apertures 401.

In FIGS. 4C, 4D, 4E, and 4F, models of two linearly integrated contours 400, 500 are shown, each of which represents an individual vortex generator contour.

400, —the first vortex generator contour on the flow of a component of a mix, having five tangential channels 404; and

500, —the second vortex generator contour, on the flow of a component of a mix also having five tangential channels 404.

Figure 5A:
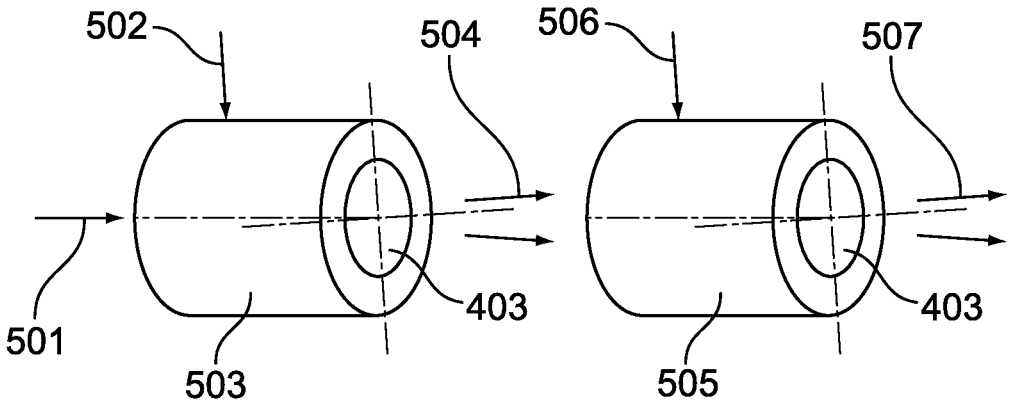
FIG. 5A is an exploded view block diagram of a device for dynamic vortex mixing and the activation containing two concentric and connected vortex generator contours.

The method of dynamic mixing within the limits of the number of vortex generator contours is now described with respect to FIG. 5A, as follows: In the embodiment of FIG. 5A, the device for dynamic vortex mixing and activation includes two coaxial and connected vortex generator contours 503, 505. There is a summation of kinetic energy in a linear stream 501, as the first components of a mix form a vortex pipe on output of each of five tangential channels 404 and add kinetic energy to the stream. After that, the mix 504 on an output from the vortex generator contour 503 has the incorporated kinetic energy and in such condition enters into the second vortex generator contour 505. The mix 504 is increased in energy within the second vortex pipe, and on an output from the second vortex generator contour 505, kinetic energy of the integrated stream of 507 mixes and combines at least the total level of kinetic energy of linear stream of 501 and the kinetic energy added within the two vortex pipes generated in vortex generator contours 503 and 505.

Figure 5B:
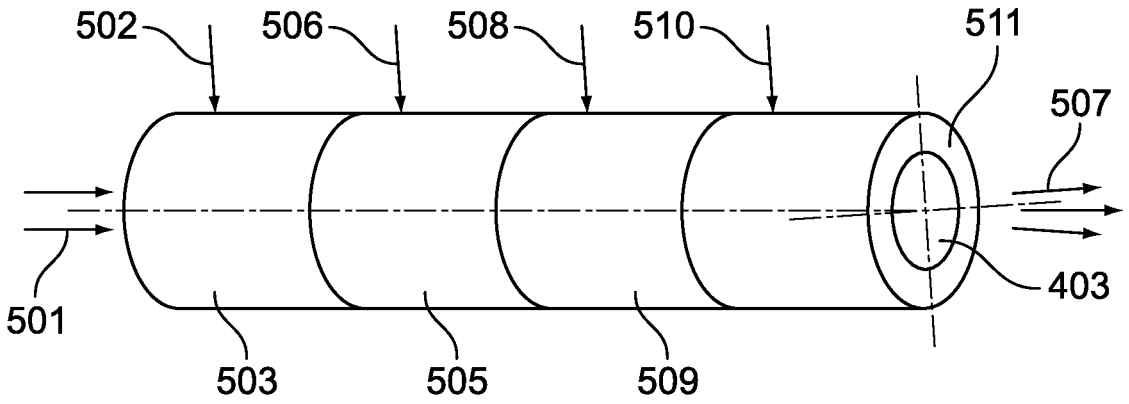
FIG. 5B is a block diagram of a device for dynamic mixing and the activation containing four connected concentric vortex generator contours.

In FIG. 5B, another embodiment of the device for dynamic mixing and activation is shown which includes four coaxially connected vortex generator contours. All coaxial vortex generator contours should be identical in size when two or more vortex generator contours are connected. In particular, all the vortex generator contours connected in one consecutive system should have equal outside diameters and equal diameters of the axial cylindrical channel 403 in which the vortex spiral is formed. The overall length of the connected vortex generator contours may vary.

FIGS. 5A and 5B include the following features:

501, —A first stream of a component of the mix. The first stream 501 enters the first axial cylindrical channel 403 of the first vortex generator contour 503;

502, —An input of a stream of a component of a mix which forms a vortex spiral in the axial cylindrical channel 403 within the first vortex generator contour 503 by movement of a stream within the first vortex generator contour 503;

503, —A first vortex generator contour;

504, —A mix produced in vortex generator contour 503 which is a component of a mix on an input into the second vortex generator contour 505;

505, —A second vortex generator contour;

506, —An input of a stream of a component of a mix which forms a vortex spiral in the axial cylindrical channel 403 within the second vortex generator contour 505 by movement of a stream within the second vortex generator contour 505;

507, —A mix on an output from the second vortex generator contour 505;

508, —An input of a stream of a component of a mix which forms a vortex spiral by movement of a stream within the third vortex generator contour 509;

509, —A third vortex generator contour;

510, —An input of a stream of a component of a mix which forms a vortex spiral in the axial cylindrical channel 403 of the fourth vortex generator contour 511 on a course of movement of a stream within the fourth vortex generator contour 511; and

511, —A fourth vortex generator contour.

The method of mixing of a first component of a mix with a second component of a mix includes the following:

The first component of a mix 101, which in some embodiments may be a liquid, is input into the entrance channel 102 of the first contour 100. By doing so, the form of the input stream will be transformed. That is, stream 101 component of a mix flowing thru 102 and further on to external surface 119 of reflector 105 will be transformed to a conical ring stream, and after that the stream enters into the conical ring channel 112 formed by a conical surface 124 in the housing 103 and the external conical surface 119 of reflector 105. The transformed stream is dispersed in the conical ring channel 112. At the output of the conical ring channel 112, a ring zone 106 of lowered pressure is formed on the ring conical area 115. The lowered pressure zone 106 acts on a stream of a liquid component of a mix to an extent that is equivalent to a difference of pressure in a stream of a liquid component of a mix 112 and pressure in the field of low pressure 106.

Simultaneously with the effect of the lowered pressure zone 106, the stream of the second component of the mix 109 is input into the housing 103. In some embodiments, the second component of the mix 109 may include a compressed gas. The compressed gas is input into the housing 108 of the second contour 200, in which it also will be transformed.

After a change of a direction of movement in a zone 104 in the second contour 200, the stream enters into the conical ring channel 113 where it is dispersed, and on an output of the channel forms the second zone of the lowered pressure in the same zone 106 on conical ring surface 114. The effort which starts to act on a stream of a gas component and is transferred to a stream of a liquid component thus is equivalent to a difference of pressure in a stream of a gas component of a mix and pressure in the zone of low pressure 106.

Thus in zones 106 and 107 there is at least a strengthening of the kinetic potential of streams of components of a mix with the simultaneous diffusive penetration of a stream of the compressed gas component into a stream of a liquid component. The resultant level of kinetic potential includes all possible components of kinetic energy which can be received in each specific application situation in view of all factors which can affect the kinetic energy level. The level of kinetic energy is the actual level of energy in the stream of a component of a mix, which is less than the kinetic potential of the stream. Communication exists between zones 106 and 107 since zone 106 is that zone in which the output of two streams of mixed components of a mix is carried out and the zone 107 is continuation of a zone 106. In zone 107, the stream of a mix is finally output and in it the final level of the kinetic energy of the mix stream is established.

With creation on surfaces 114 and 115 of maximum levels of low pressure, a stronger penetration of a compressed gas component stream into the liquid component of a mix occurs. The force of penetration of the gas component into the liquid component increases based upon the difference of pressure between the area of low pressure and the pressure in each of streams, and the kinetic potential of the mix and its components. The resultant level of kinetic potential includes all possible components of kinetic energy which can be received in each specific application situation in view of all factors which can affect the kinetic energy level. The level of kinetic energy is the actual level of energy in the stream of a component of a mix, which is less than the kinetic potential of the stream. The system behaves similarly both with mixing a liquid with a liquid and with mixing a gas with gas.

When mixing more than two components within the limits of two incorporated contours, each additional component is involved in the incorporated zone of the lowered pressure, and both the further mixing and the increase of kinetic potential occur similarly as with a method of mixing two components. The resultant level of kinetic potential includes all possible components of kinetic energy which can be received in each specific application situation in view of all factors which can affect the kinetic energy level. The level of kinetic energy is the actual level of energy in the stream of a component of a mix, which is less than the kinetic potential of the stream. The quantity of vortex generator contours for mixing and activation can be variously increased to any number greater than two. In each vortex generator contour, identical methods of mixing and activation of two components of a mix occur. The resultant level of kinetic potential includes all possible components of kinetic energy which can be received in each specific application situation in view of all factors which can affect the kinetic energy level. The level of kinetic energy is the actual level of energy in the stream of a component of a mix, which is less than the kinetic potential of the stream.

Using the technique of vortex mixing, a linear stream is formed of one liquid or gas component of a mix in the axial cylindrical channel 403 of the vortex generator contour 400, and around it the vortex generator contour 400 processes a second component of a mix through its tangential channels 404. A vortex spiral 407 is then created in the axial cylindrical channel 403 of the vortex generator contour as the linear and spiral component streams mix to form an integrated stream. A force vector is created within the vortex spiral 407 which coincides with the direction of movement of a stream of the first component of a mix and this force vector increases the level of turbulence of the integrated stream and raises its level of kinetic potential. The resultant level of kinetic potential includes all possible components of kinetic energy which can be received in each specific application situation in view of all factors which can affect the kinetic energy level. The level of kinetic energy is the actual level of energy in the stream of a component of a mix, which is less than the kinetic potential of the stream. Applications employing vortex generator contours and methods may be configured with any number of vortex generator contours that may be connected in linear as well as non-linear configurations or combinations thereof, providing flexibility in design as well as meeting the varying requirements for different levels of kinetic energy that may arise from one unique application to another or within a specific application.

What is claimed is:

1. A method of dynamic mixing of at least a first fluid stream and a second fluid stream to provide a mixed stream having increased kinetic energy and transformed fluid properties, the method including the following method steps:

providing at least two integrated dynamic contours that are configured to simultaneously direct fluid flow on both sides of a reflector with an external reflecting surface and an internal reflecting surface, where a first dynamic contour of the at least two integrated dynamic contours includes a first housing and a conical ring for dispersal within the limits of the first dynamic contour, and a second dynamic contour of the at least two integrated dynamic contours includes a second housing, wherein the external reflecting surface next to the first dynamic contour and the internal reflecting surface next to the second dynamic contour and transform the kinetic energy level of the first and second fluid streams; and directing fluid flow by the at least two integrated dynamic contours for dispersal such that, the first and second fluid streams are input in opposite directions, changing the direction of the fluid flow of the first fluid stream between the first dynamic contour and the external reflecting surface and the second fluid stream between the second dynamic contour and the internal reflecting surface so they become co-terminus, wherein a zone of accumulation of kinetic energy of the mixed stream is formed at the junction of the adjacent contours such that the first fluid stream and the second fluid stream and mix forming the mixed stream, as the first fluid stream and the second fluid stream move into the zone of accumulation, the physical effects acting on the first fluid stream and the second fluid stream are combined, increasing the kinetic energy of the mixed stream and transforming the mixed stream from a first kinetic energy level to a second kinetic energy level, where the second kinetic energy level is greater than the first kinetic energy level, and each of the at least two integrated dynamic contours operates independently.

2. The method of claim 1 wherein the first fluid stream is a liquid and the second fluid stream is a gas.

3. The method of claim 1 wherein the first fluid stream is a first liquid and the second fluid stream is a second liquid.

4. The method of claim 1 wherein the first fluid stream is a first gas and the second fluid stream is a second gas.

5. The method of claim 1 wherein each of the at least two integrated dynamic contours operates independently on the basis of one of known dynamic physical principles of turbulence.

6. A method of dynamic mixing of at least a first fluid stream and a second fluid stream to provide a mixed stream having increased kinetic energy and transformed properties, the first fluid stream comprising a liquid and the second fluid stream comprising a gas, the method including the following method steps:

providing at least two integrated dynamic contours that are configured to simultaneously direct fluid flow on both sides of a reflector with an external reflecting surface and an internal reflecting surface, where a first dynamic contour of the at least two integrated dynamic contours includes a first housing and a conical ring for dispersal within the limits of the first dynamic contour, and a second dynamic contour of the at least two integrated dynamic contours includes a second housing, wherein the external reflecting surface next to the first dynamic contour and the internal reflecting surface next to the second dynamic contour and transform the energy level of the first and second fluid streams;

directing fluid flow by the at least two integrated dynamic contours for dispersal such that, the first and second fluid streams are input in opposite directions, and a third fluid stream is added to the mixed stream formed by the first fluid stream and the second fluid stream in a direction perpendicular to the flow direction of the mixed stream, changing the direction of the fluid flow of the first fluid stream between the first dynamic contour and the external reflecting surface and the second fluid stream between the second dynamic contour and the internal reflecting surface so they become co-terminus, wherein a zone of accumulation of kinetic energy of the mixed stream is formed at the junction of the adjacent contours such that the first fluid stream and the second fluid stream and mix forming the mixed steam, as the first fluid stream and the second fluid stream move into the zone of accumulation, the physical effects acting on the first fluid stream and the second fluid stream are combined, increasing the kinetic energy of the mixed stream and transforming the mixed stream from a first kinetic energy level to a second kinetic energy level, where the second kinetic energy level is greater than the first kinetic energy level, and each of the at least two integrated dynamic contours operates independently.

7. A method of dynamic mixing of at least a first fluid stream and a second fluid stream to provide a mixed stream having increased kinetic energy and transformed fluid properties, the method including the following method steps:

providing at least two integrated dynamic contours that are configured to simultaneously direct fluid flow on both sides of a reflector with an external reflecting surface and an internal reflecting surface, where a first dynamic contour of the at least two integrated dynamic contours includes a first housing and a conical ring for dispersal within the limits of the first dynamic contour, and a second dynamic contour of the at least two integrated dynamic contours includes a second housing, wherein the external reflecting surface next to the first dynamic contour and the internal reflecting surface next to the second dynamic contour and transform the kinetic energy level of the first and second fluid streams; and directing fluid flow by the at least two integrated dynamic contours for dispersal such that, the first and second fluid streams are input in opposite directions, changing the direction of the fluid flow of the first fluid stream between the first dynamic contour and the external reflecting surface and the second fluid stream between the second dynamic contour and the internal reflecting surface so they become co-terminus, wherein a zone of accumulation of kinetic energy of the mixed stream is formed at the junction of the adjacent contours such that the first fluid stream and the second fluid stream and mix forming the mixed stream, as the first fluid stream and the second fluid stream of the mixed stream move into the zone of accumulation, the physical effects acting on the first fluid stream and the second fluid stream are combined, increasing the kinetic energy of the mixed stream and transforming the mixed stream from a first kinetic energy level to a second kinetic energy level, where the second kinetic energy level is greater than the first kinetic energy level, and each of the first and second housings and the reflector are non moving parts.

8. The method of claim 1 wherein the first fluid stream is a gas and the second fluid stream is an aerosol.

9. The method of claim 7, wherein the first fluid stream is a gas and the second fluid stream is an aerosol.

* * * * *